United States Patent [19]

Horinouchi

[11] 4,390,766

[45] Jun. 28, 1983

[54] APPARATUS AND METHOD FOR CONTROLLING ELECTRONIC CONTROLLED COOKING APPARATUS HAVING STORAGE

[75] Inventor: Atsushi Horinouchi, Otsu, Japan

[73] Assignee: Sanyo Electric Co., Ltd., Moriguchi, Japan

[21] Appl. No.: 123,021

[22] Filed: Feb. 20, 1980

[30] Foreign Application Priority Data

Feb. 28, 1979 [JP] Japan ..... 54-23802

[51] Int. Cl.[3] ..... H05B 1/02; H05B 9/06

[52] U.S. Cl. ..... 219/10.55 B; 219/506; 340/365 R; 340/309.4; 364/705

[58] Field of Search ..... 219/10.55 B, 492, 506, 219/507–509; 364/900, 400, 420, 421, 705, 709; 340/365 R, 337, 309.4, 304, 172

[56] References Cited

U.S. PATENT DOCUMENTS

| | | | |
|---|---|---|---|
| 3,911,424 | 10/1975 | Giannuzzi et al. | 364/900 |
| 3,942,175 | 3/1976 | Collins et al. | 340/365 R |
| 4,158,432 | 6/1979 | Van Bavel | 219/10.55 B |
| 4,158,759 | 6/1979 | Mason | 219/10.55 B |
| 4,178,633 | 12/1979 | Olander, Jr. et al. | 364/900 |
| 4,255,639 | 3/1981 | Kawabata et al. | 219/506 |
| 4,295,027 | 10/1981 | Zushi et al. | 219/10.55 B |

*Primary Examiner*—M. H. Paschall

*Attorney, Agent, or Firm*—Darby & Darby

[57] ABSTRACT

A microwave oven including a keyboard, a microwave generating circuit, and a microprocessor for controlling the same. The keyboard has function keys for setting cooking conditions, numeral keys, and a memory key for commanding storage and retrieval of cooking information from a random access memory. The microprocessor is responsive to an operation of the memory key to transfer cooking information set by the function keys and numeral keys, from a buffer memory to a particular storing stage of the random access memory, according to the setting of a number of flag bits in the buffer memory. New cooking information is then transferred to the buffer memory from the next storing stage of the random access memory, and the flag bits are reset to indicate which storing stage corresponds to this information. The cooking and stage identifying information in buffer memory is read out by a display, and the displayed cooking information may be changed without affecting the content of the other storing stages in the random access memory.

20 Claims, 21 Drawing Figures

FIG. 1A
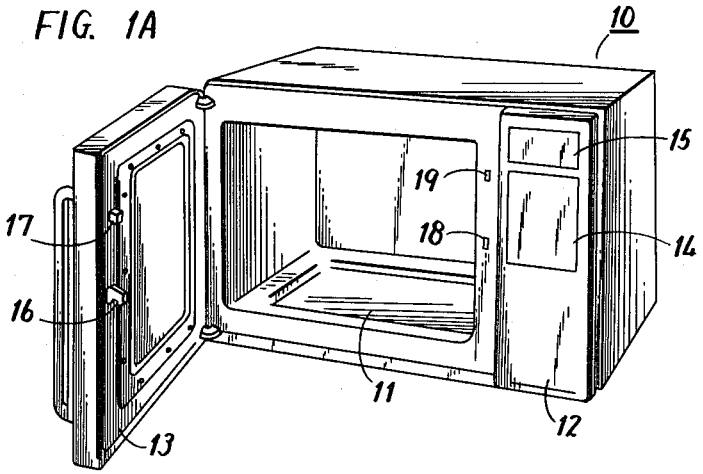
FIG. 1B
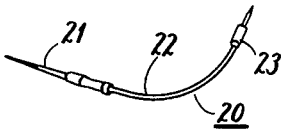
FIG. 3
| | | |
|---|---|---|
| TOD | TIME | TEMP |
| 7 | 8 | 9 |
| 4 | 5 | 6 |
| 1 | 2 | 3 |
| COOK | MEMORY | 0 |
| CLEAR | START | STOP |
14
FIG. 4
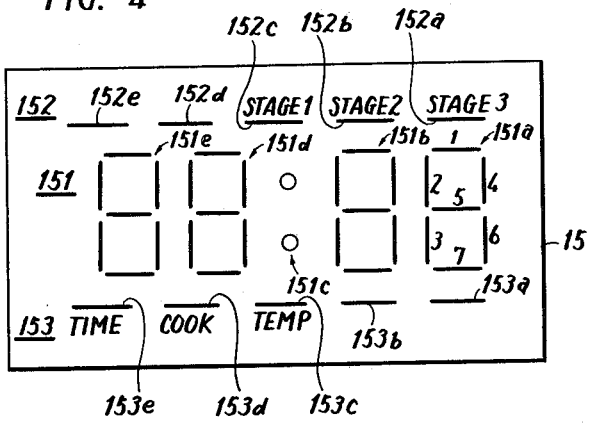

FIG. 5
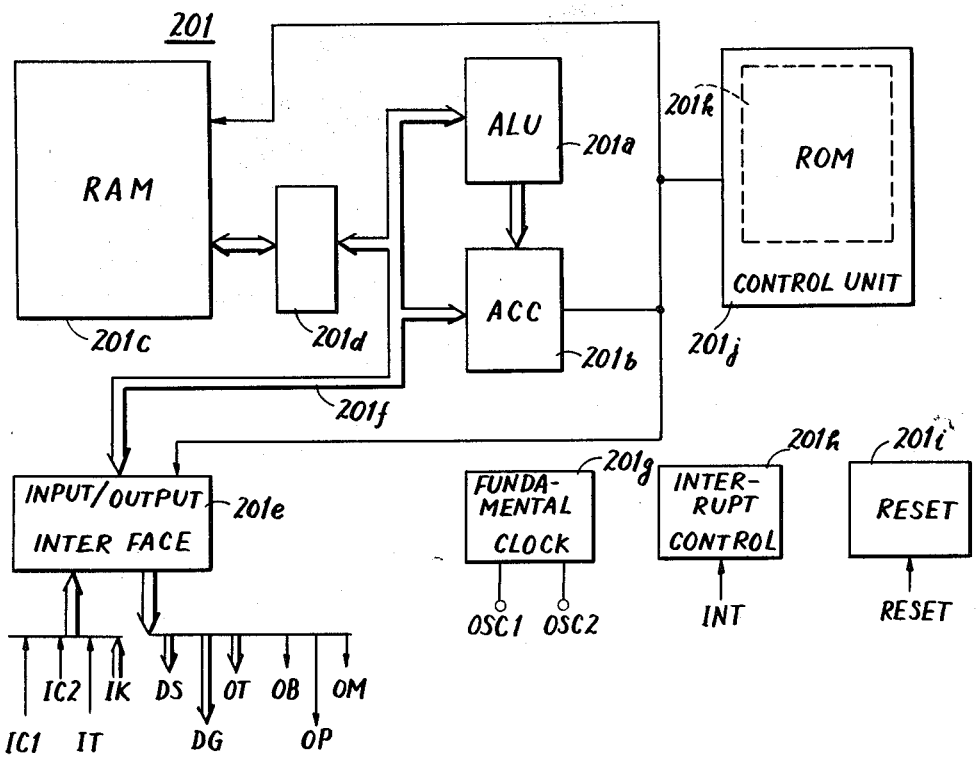
FIG. 6A
201d
| | | | | | | | | | | | |
|---|---|---|---|---|---|---|---|---|---|---|---|
| TIME B | COOK B | TEMP B | TM B | TP B | CO B | STG1 B | STG2 B | STG3 B | TM F | TP F | CO F |
FIG. 6B
201c
| | | | | | | | | |
|---|---|---|---|---|---|---|---|---|
| TIME 1 | COOK 1 | TEMP 1 | TM 1 | TP 1 | CO 1 | STG 1 | | |
| TIME 2 | COOK 2 | TEMP 2 | TM 2 | TP 2 | CO 2 | | STG 2 | |
| TIME 3 | COOK 3 | TEMP 3 | TM 3 | TP 3 | CO 3 | | | STG 3 |
FIG. 7
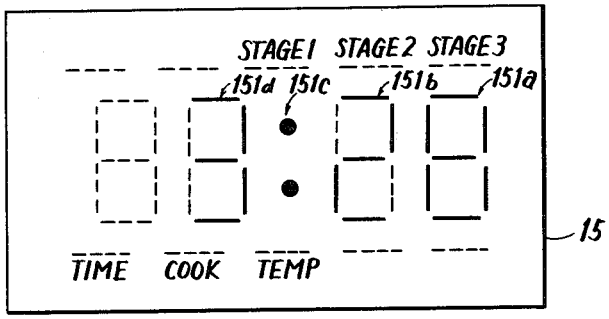

FIG. 8

| | AREA / KEY | TIME B | COOK B | TEMP B | TM B | TP B | CO B | STG 1 B | STG 2 B | STG 3 B | TM F | TP F | CO F |
|---|---|---|---|---|---|---|---|---|---|---|---|---|---|
| A | TIME | | | | | | | 1 | | | 1 | | |
| | 5 | 5 | | | 1 | | | 1 | | | 1 | | |
| | 3 | 53 | | | 1 | | | 1 | | | 1 | | |
| B | 0 | 530 | | | 1 | | | 1 | | | 1 | | |
| C | COOK | 530 | | | 1 | | | 1 | | | | | 1 |
| | 8 | 530 | 8 | | 1 | | 1 | 1 | | | | | 1 |
| D | 0 | 530 | 80 | | 1 | | 1 | 1 | | | | | 1 |
| E | MEMORY | | | | | | | | 1 | | | | |
| | TEMP | | | | | | | | 1 | | | 1 | |
| | 1 | | | 1 | | 1 | | | 1 | | | 1 | |
| | 6 | | | 16 | | 1 | | | 1 | | | 1 | |
| F | 5 | | | 165 | | 1 | | | 1 | | | 1 | |
| | COOK | | | 165 | | 1 | | | 1 | | | | 1 |
| | 5 | | 5 | 165 | | 1 | 1 | | 1 | | | | 1 |
| G | 0 | | 50 | 165 | | 1 | 1 | | 1 | | | | 1 |
| H | MEMORY | | | | | | | | | 1 | | | |
| | TIME | | | | | | | | | 1 | 1 | | |
| | 5 | 5 | | | 1 | | | | | 1 | 1 | | |
| | 0 | 50 | | | 1 | | | | | 1 | 1 | | |
| | 0 | 500 | | | 1 | | | | | 1 | 1 | | |
| I | COOK | 500 | | | 1 | | | | | 1 | | | 1 |
| | 8 | 500 | 8 | | 1 | | 1 | | | 1 | | | 1 |
| J | 0 | 500 | 80 | | 1 | | 1 | | | 1 | | | 1 |

FIG. 9-1
A
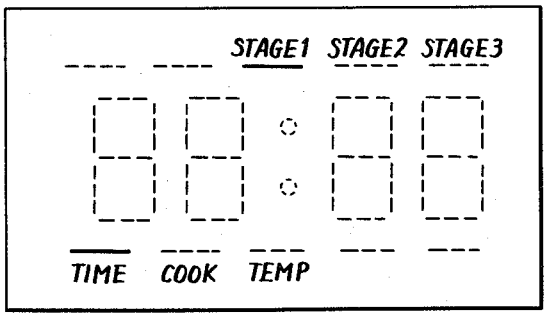
B
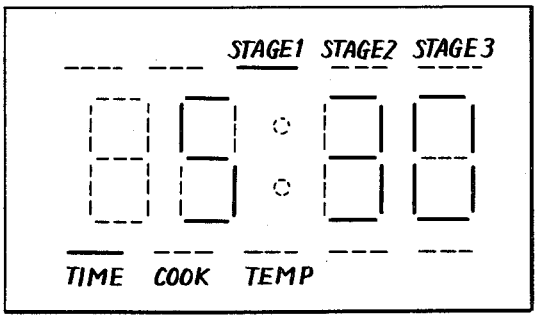
C
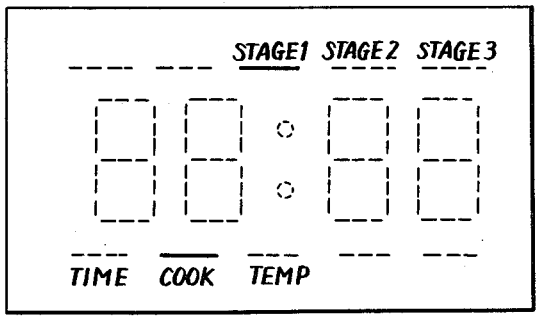
D
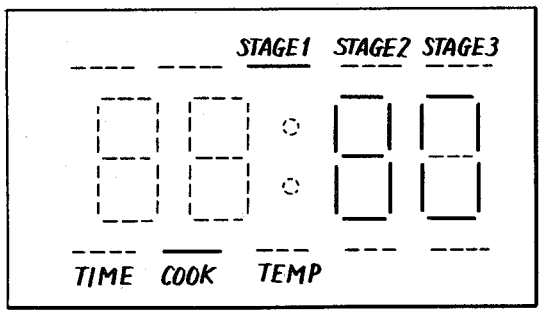

FIG. 9-2
E
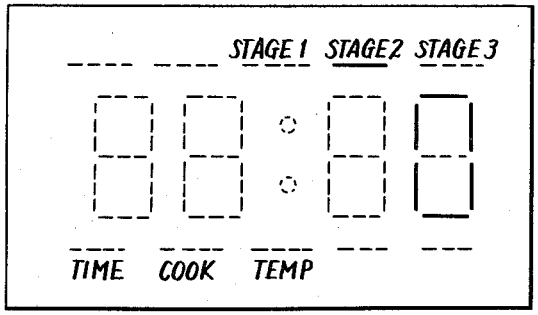
F
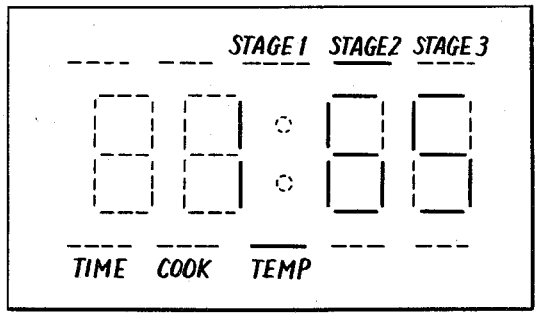
G
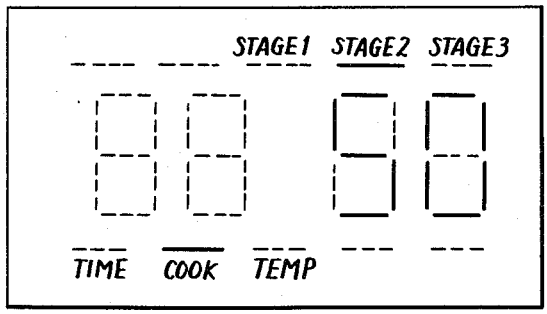
H
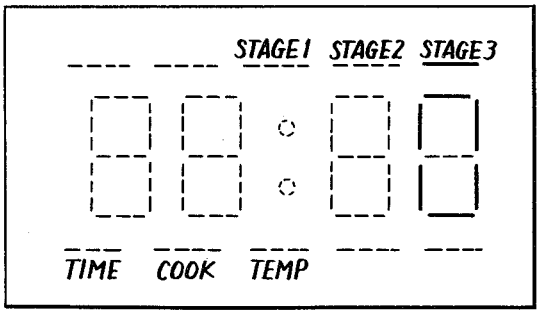

I

J

APPARATUS AND METHOD FOR CONTROLLING ELECTRONIC CONTROLLED COOKING APPARATUS HAVING STORAGE

BACKGROUND OF THE INVENTION

1. Field of the Invention

The present invention relates to an apparatus and method for controlling an electronic controlled cooking apparatus having a storage. More specifically, the present invention relates to an apparatus and method for controlling an electronic controlled heat cooking apparatus having a storage for storing cooking condition data being set by an entry means for each of a plurality of stages and for controlling generation of heating energy based on the stored cooking condition data for each of the stages of the storage.

2. Description of the Prior Art

As an example of a heat cooking apparatus, microwave ovens are well known. Of late, a microprocessor implemented as a large scale integration has been employed in such a microwave oven for the purpose of performing various cooking functions. A microwave oven employing a microprocessor can perform various complicated cooking modes with a simple structure and through a simple manual operation. Such cooking modes comprise a timer operation for performing a cooking operation within a preset time period, a temperature operation for performing a cooking operation within a predetermined temperature range, and the like. Such timer operation data, temperature operation data, and the like are stored at each of a plurality of stages of a storage included in a microprocessor, so that generation of a microwave is controlled in accordance with a sequential reading. For example, a temperature operation is set in a first stage and a timer operation is set in a second stage. In such a case, when initiation of an operation of a microwave oven is commanded, first the temperature operation set in the first stage of the storage is executed, whereupon the timer operation set in the second stage is continually executed.

In the case of such a conventional microwave oven, cooking condition data is set in each of the stages and correction and change of such data cannot be made. More specifically, with such a conventional microwave oven, once cooking condition data is set in all of the stages, even in changing the cooking condition data of only the first stage, for example, the contents in all the stages of the storage are cleared by means of a clear key and then the cooking condition data must be reentered in each of the stages. Thus, a conventional microwave oven was extremely inconvenient.

SUMMARY OF THE INVENTION

In order to eliminate the above described inconveniences, the present invention comprises a stage designating means capable of accessing any stages of a storage provided in an electronic controlled cooking apparatus. According to the present invention, therefore, any stages of the storage can be accessed as necessary and therefore any necessity of clearing all the stored contents and reentering the cooking condition data in the stages concerned as conventionally done is eliminated even in the case where the cooking condition data in only one stage should be corrected or changed. Accordingly, it is possible to change such cooking condition data with extreme ease.

In a preferred embodiment of the present invention, the stage being accessed is determined in association with the number of manual operations of a particular function key included in an entry means. Accordingly, any necessity of providing keys for the respective stages is precluded. The preferred embodiment is further adapted such that the first stage may be accessed upon manual operation of any other function keys before manual operation of the above described particular function key. Accordingly, facility of manual operation in setting the cooking conditions is further enhanced.

In another preferred embodiment of the present invention, since the number of the stage being designated is indicated, an operator can learn with ease the number of the stage which he wishes to designate.

Accordingly, a principal object of the present invention is to provide an improved apparatus and method for controlling an electronic controlled cooking apparatus.

Another object of the present invention is to provide an apparatus and method for controlling an electronic controlled cooking apparatus adapted for storing cooking condition data at each of a plurality of stages in storage means, wherein any desired stage can be accessed with extreme ease.

A further object of the present invention is to provide an apparatus and method for controlling an electronic controlled cooking apparatus, wherein cooking condition data can be set in any desired stage among a plurality of stages of a storage without clearing the cooking condition data in all stages.

Still a further object of the present invention is to provide an apparatus and method for controlling an electronic controlled cooking apparatus, wherein a stage being accessed among a plurality of stages of a storage can be confirmed through a visual indication.

BRIEF DESCRIPTION OF THE DRAWINGS

FIG. 1A is a perspective view of a microwave oven wherein the present invention can be advantageously employed;

FIG. 1B is a view showing one example of a temperature measuring probe for use in a temperature operation mode;

FIG. 4 is a view showing a display portion;

FIG. 5 is an outline block diagram showing a structure of a microprocessor;

FIG. 6A is a view showing storing regions in a buffer register;

FIG. 6B is a view showing storing regions of the respective stages of a random access memory;

FIG. 7 is a view showing one example of a current time indication by the display portion;

FIG. 8 is a table showing transition of storing states in the buffer register responsive to sequential key operation;

DESCRIPTION OF THE PREFERRED EMBODIMENTS

Figure 2:
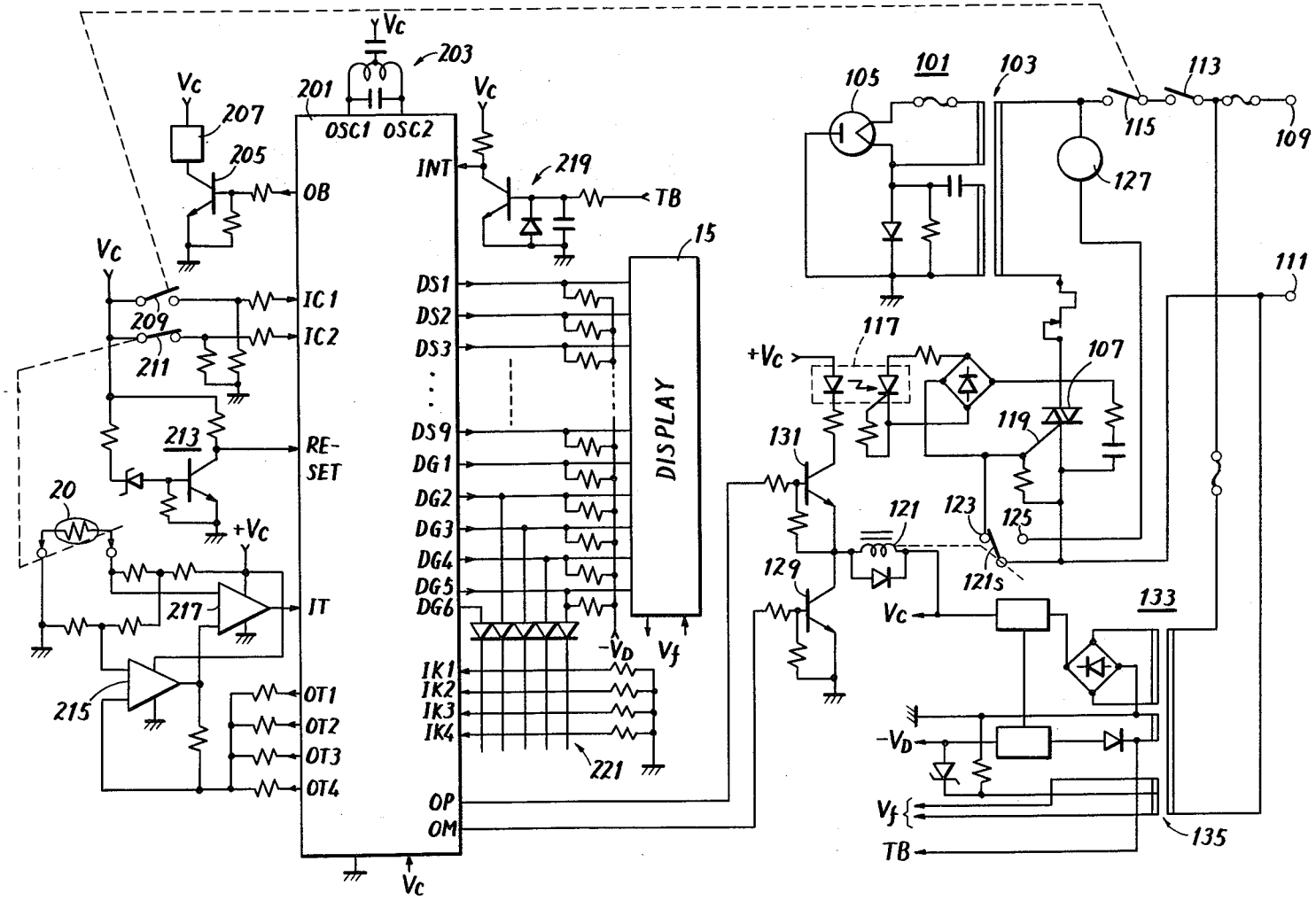
FIG. 2 is a schematic diagram of one embodiment of the present invention.

In the following detailed description of the preferred embodiments of the present invention, the present invention will be described as advantageously employed in a microwave oven. However, it should be pointed out that the present invention is not limited to such embodiments but the present invention can be employed in any other types of heat cooking apparatus for cooking a material being cooked by application of heat thereto, such as a gas oven, an electric oven, an electric grill, an electric roaster and the like.

FIG. 1A is a perspective view of a microwave oven embodying the present invention. FIG. 1B is a view showing a temperature measuring probe as one example of a temperature detecting means. A microwave oven 10 has a main body comprising a cooking chamber 11 and a control panel 12. The main body of the microwave oven has a door 13 openably/closably provided to enclose an opening of the cooking chamber 2. The control panel 12 comprises an operation portion 14 for setting various cooking modes and for entering necessary data, and a display 15 for displaying in a digital manner the entered data, a measured temperature, a time period left in a timer, and the like. The operation portion 14 and the display portion 15 will be described in more detail subsequently. The door 13 is provided with a door latch 16 and a door switch knob 17 on the inner surface thereof. The door latch 16 and the door switch knob 17 are adapted to enter into apertures 18 and 19, respectively, formed on the main body, when the door 13 is closed, so that an interlock switch and a door switch, respectively, shown in FIG. 2, may be turned on.

A probe 20 comprises a needle-like inserting portion 21 and a plug 23. In using the probe 20, the inserting portion 21 is inserted into a material being cooked, while the plug 23 is coupled to a connecting portion or a receptacle, not shown, provided on the inner wall of the cooking chamber 11. The inserting portion 21 of the probe 20 comprises a thermistor, not shown, housed therein exhibiting a resistance characteristic changeable as a function of a temperature of a material being cooked. The thermistor and the plug 23 are coupled by a shield wire 22, for example, so that the probe 20 is coupled to the circuit shown in FIG. 2 when the probe 20 is utilized.

FIG. 2 is a schematic diagram of a preferred embodiment of the present invention. A microwave generating portion 101 is coupled to terminals 109 and 111 of a commercial power supply through an interlock switch 113 and a door switch 115 and a bidirectional thyristor 107. The microwave generating portion 101 is sturctured "structured" in a well known manner and may comprise a high voltage transformer 103 for transforming a source voltage obtained from the terminals 109 and 111, a magnetron 105 coupled to the output winding of the high voltage transformer 103, and the like. The interlock switch 113 and the door switch 115 are adapted to be turned on by means of the door latches 16 and 18 and the door switch knobs 17 and 19, respectively, shown in FIG. 1A. The bidirectional thyristor 107 is rendered conductive if and when the output voltage of a photocoupler 117 is applied to the gate electrode 119 thereof. Accordingly, if and when the door 13 shown in FIG. 1A is closed and the output voltage is obtained from the photocoupler 117, an alternating source voltage obtained from the terminals 109 and 111 is applied to the microwave generating portion 101 and accordingly a microwave is generated from the microwave generating portion 101, which microwave energy is supplied to the cooking chamber 11 shown in FIG. 1A. The photocoupler 117 becomes operative if and when a first and second transistors 129 and 131 are both rendered conductive, whereby an output voltage is withdrawn.

The gate electrode 119 of the bidirectional thyristor 107 is coupled to the voltage source terminal 111 through a normally closed contact 123 of a relay 121. Accordingly, the thyristor 107 is normally shortcircuited and therefore the gate electrode 119 is prevented from being undesirably supplied with a voltage due to an external noise and the like and hence the bidirectional thyristor 107 is prevented from being undesirably rendered conductive. The relay 121 is energized when the first transistor 129 is rendered conductive, a normally opened contact 125 of the relay 121 being connected to a blower motor 127. The blower motor 127 is adapted for driving a fan, not shown, for cooling the magnetron 105 and the like. The voltage source terminals 109 and 111 are further connected to a control voltage source 133. The control voltage source 133 comprises a transformer 135 for transforming the voltage supplied from the terminals 109 and 111 to a lower voltage for supplying direct current source voltages $V_C$ and $-V_D$ fed to various portions of the circuit, a voltage $V_f$ fed to a display 15 and a time base signal TB.

Figures 1, 10:
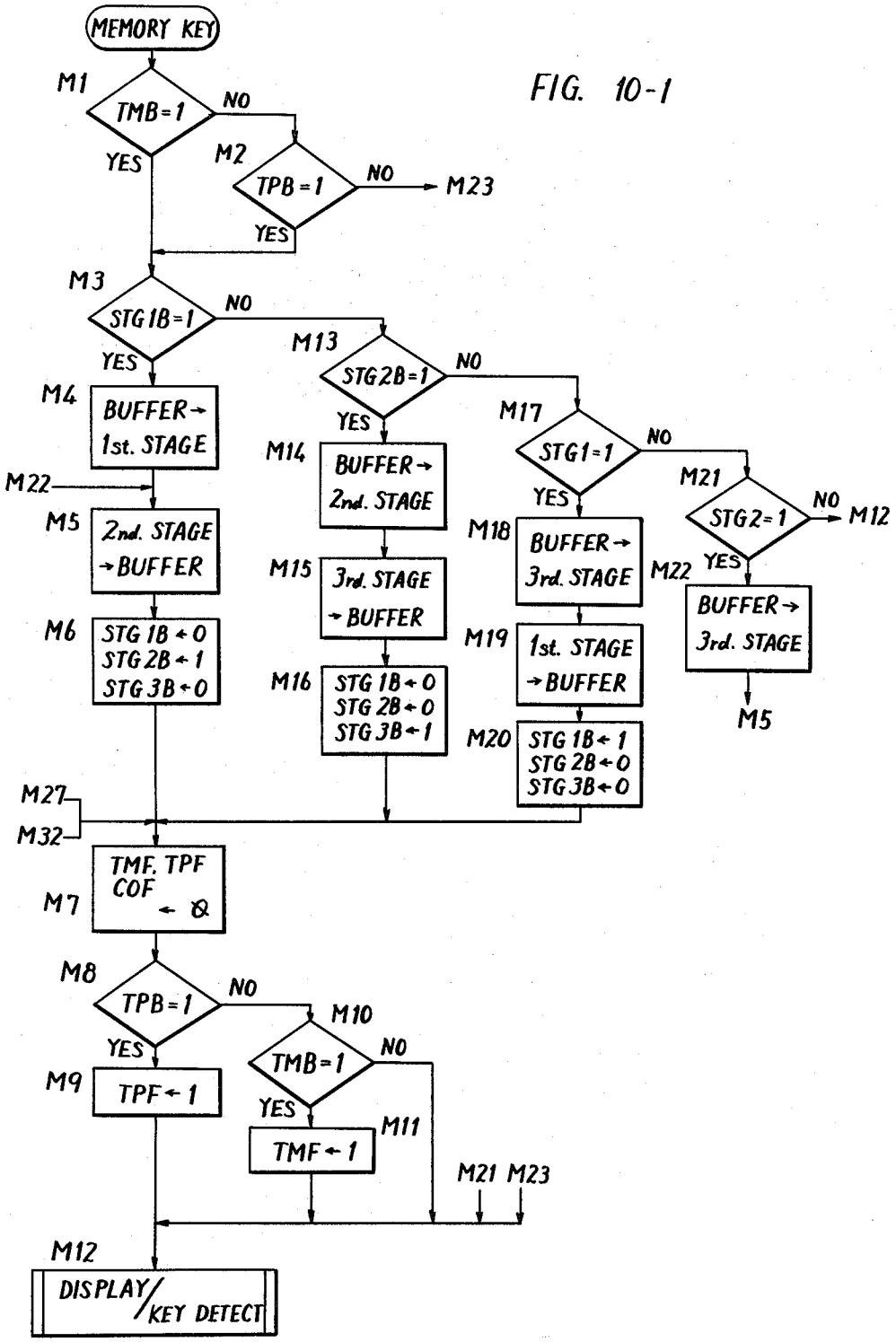
FIG. 10 is a flow diagram for depicting an operation of the present invention.
Figures 2, 10:
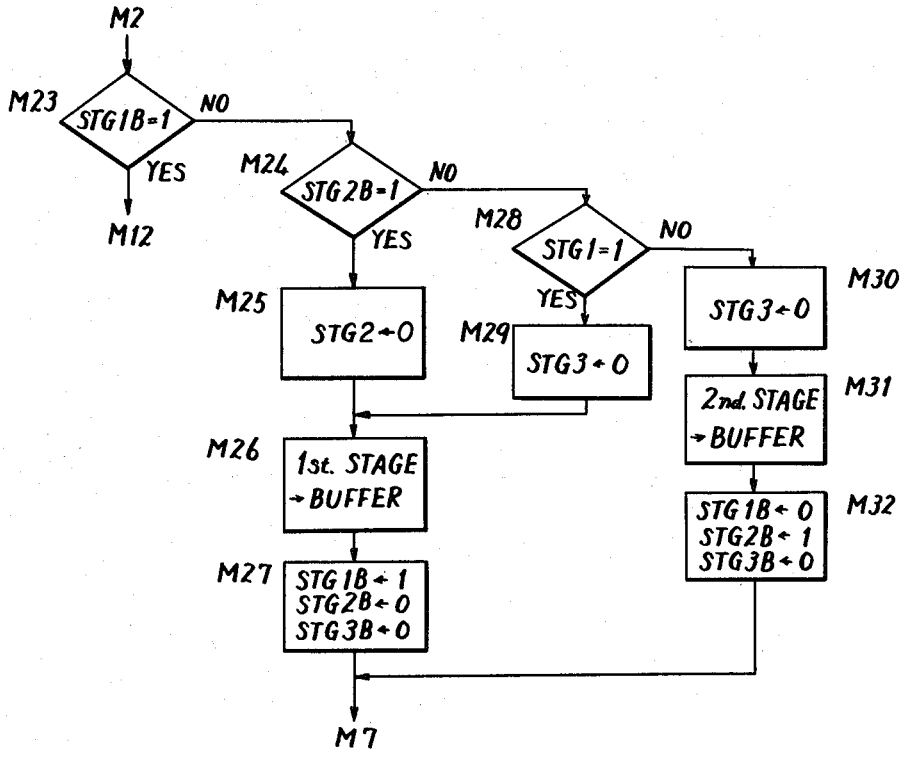

The embodiment shown employs a one chip microprocessor implemented as a large scale integration for controlling the above described microwave generating portion 101 and the like. The microprocessor 201 may be model "μPD553" manufactured by Nippon Electric Company Limited, Japan, for example. Such microprocessor 201 has a multiplicity of input and output terminals. Connection temrinals OSC1 and OSC2 are used for connecting an external component 203 constituting a portion of a clock source. The external component 203 is cooperative with the microprocessor 201 to generate a synchronizing clock, so that the microprocessor 201 may execute the program steps in synchronism with the clock. Although not shown in the figure, the microprocessor 201 comprises a read only memory having system programs as shown in FIGS. 5 and 10 to be described subsequently, a random access memory for storing data, an arithmetic logic unit and the like, as well known to those skilled in the art.

Figure 3:
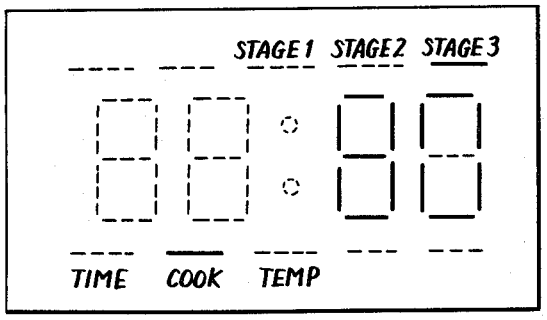
FIG. 3 is a view showing an operation portion.

The microprocessor 201 is coupled to the display 15 through data output terminals DS1 to DS9. The display 15 is further supplied with a display control signal through control signal output terminals DG1 to DG5. The display control signal functions as a digit selecting signal for driving in a time sharing basis each of display digit to be described subsequently of the display 15. The control signal terminals DG2 to DG5 and an additional control signal output terminal DG6 are coupled to column lines of a key matrix 221. The key matrix 221 comprises four row lines connected to key input terminals IK1, IK2, IK3 and IK4 of the microprocessor 201. The above described column lines and row lines constitute a matrix, such that an intersection of each column line and each row line is provided with a key switch of the operation portion 14 (see FIG. 3). The operation portion 14 comprises ten numeral keys standing for numerals "0" to "9" and seven function keys, as shown in FIG. 3. The function keys comprise those keys denoted as TOD, TIME, TEMP, COOK, CLEAR, START, STOP and MEMORY. The TOD key is used for time setting. The TIME key is used for setting a timer operation mode. The TEMP key is used for setting a temperature operation mode. The COOK key is used for setting a heat cooking mode. The START key is used for commanding initiation of microwave generation by the magnetron 46. The STOP key is used to stop or discontinue the operation. The MEMORY key is used in writing data in a random-access memory to be described subsequently and is also used to designate stages of the random-access memory. Each of these keys may be implemented by a typical contact type depression button switch. The input from the key matrix 221 coupled to these keys is applied to the key input terminals IK1 to IK4 as a key code signal. The microprocessor 201 is responsive to the key code signal applied to the terminals IK1 to IK4 to detect or identifiy which key is depressed.

The display 15 is structured as shown in FIG. 4, for example, by means of a fluorescent type display tube. More specifically, the display 15 comprises a numerical value display portion 151 and bar display portions 152 and 153. The numerical value display portion 151 comprises four numeral display portions 151*a*, 151*b*, 151*d* and 151*e*, each including an "8" shaped segment arrangement, and a colon display portion 151*c* formed between the numeral display portions 151*b* and 151*d*. The bar display portions 152 and 153 each have bar segments 152*a* to 152*e* and 153*a* to 153*e* corresponding to each of the digits of the numerical value display portion 151. Indications "STAGE 1" "STAGE 2" and "STAGE 3" are formed above the bar segments 152*c*, 152*b* and 152*a*. Indications "TEMP" and "COOK" and "TIME" are formed below the bar segments 153*c*, 153*d* and 153*e*. The output signal obtained from the output terminals DG1 to DG5 of the microprocessor 201 functions as a digit selecting signal of the respective display digits a to e. On the other hand, the output signal obtained from the output terminals DS1 to DS7 functions as a segment selecting signal corresponding to the respective segments in each of the numeral display portions. The output signal obtained from the output terminals DS8 and DS9 functions as a selection signal of the bar display portions 152 and 153. Accordingly, if and when a signal is obtained from the output terminal DG2, for example, and the output signal is obtained at the terminals DS1, DS3, DS4, DS5, DS7 and DS8 and DS9, a numeral "2" is displayed at the numeral display portion 151*b* and the bar segments 152*b* and 153*b* are enabled to emit light. The output signal obtained from the output terminal DS1 functions as a selection signal of the colon display 151*c*. Accordingly, if and when the output signal is obtained from the output terminal DG3 and the output signal is obtained from the terminals DS1 and DS8, the colon display 151*c* is enabled to emit light and the bar segment 152*c* is also enabled to emit light.

Returning to FIG. 2, the output terminal OB of the microprocessor 201 is a buzzer terminal. If and when an output signal is obtained at the terminal OB, the transistor 205 coupled thereto is rendered conductive, whereby the buzzer 207 is driven to raise an alarm. The buzzer 207 is used to generate a confirmation alarm responsive to a key operation of the above described operation portion 14, completion of cooking, and the like. However, the buzzer 207 may also be used as an alarming means to be described subsequently.

The input terminal IC1 of the microprocessor 201 is an input terminal for detecting an opened/closed state of the door 13 shown in FIG. 1. More specifically, the second door switch 209 adapted to be turned on responsive to the door switch knob 17 (FIG. 1) is connected to the input terminal IC1. Accordingly, in the absence of the input signal at the terminal IC1, i.e. if and when the second door switch 209 is turned off, the microprocessor 201 determines that the door 13 has been opened. In such a situation, the microprocessor 201 performs necessary operations such as interruption of its own operation, and the like.

The input terminal IC2 is an input terminal for detecting a connected/disconnected state of the probe 20. More specifically, a probe switch 211 for connecting the probe 20 is connected to the input terminal IC2. The probe switch 211 is operable in a ganged fashion with a receptacle, not shown, provided on the inner wall of the cooking chamber 11 (FIG. 1), such that the probe switch 211 is turned on when the probe 20 is connected to the receptacle. Accordingly, the microprocessor 201 determines a connected/disconnected state of the probe 20 based on the presence or absence of an input signal to the input terminal IC2.

The input terminal RESET is a terminal for initially resetting the microprocessor 201 upon turning on of a power supply to the microwave oven. More specifically, if and when the power supply is turned on, the rise of the source voltage $V_C$ obtained from the control voltage source 133 is detected by means of a detecting circuit 213 implemented by a transistor and a Zener diode. The output from the detecting circuit 213 is applied to the terminal RESET. Then the microprocessor 201 resets the respective portions to an initial condition.

The input terminal IT and the output terminals OT1 to OT4 are terminals for temeperature measurement by the probe 20. The microprocessor 201 provides a binary signal of four bits at the output terminals OT1 to OT4, so that the bit pattern of the binary signal is changed in a cyclic manner at a high speed to sixteen states of "0000", "0001", . . . "0100", . . . "1100", . . . "1111". The above described sixteen states of the binary signal each have been defined to represent a particular temperature. For example, the bit pattern "0000" is allotted to 185° F., for example, and the bit pattern "1111" is allotted to 110° F., for example, while one change of the bit pattern is allotted to a change of 5° F. The binary signal output of four bits at the output terminals OT1 to OT4 are converted to a stepwise analog voltage by means of an amplifier 215 commonly coupled to resistors coupled to the output terminals OT1 to OT4, respectively. The analog voltage obtained from the amplifier 215 contains information concerning the binary signal, i.e. the temperature and is applied to one input of a comparator 217. The other input of the comparator 217 is connected to receive a voltage associated with the temperature of a material being cooked, not shown, obtained from the probe 20 connected to the receptacle, not shown. The comparator 217 provides a coincidence signal if and when these two input voltages coincide with each other, which coincidence signal is applied to the input terminal IT of the microprocessor 201. If and when the signal is received at the terminal IT, the microprocessor 201 immediately stops a change of the above described four-bit pattern of the binary signal. More specifically, a bit pattern of the four-bit binary signal obtainable when the above described coincidence signal is inputted substantially corresponds to a temperature of the material being cooked as detected by the probe 20 and the microprocessor 201 processes the above described bit pattern of the binary signal as a temperature of the material being cooked.

An interrupt signal is applied to the input terminal INT of the microprocessor 201. More specifically, the time base signal obtained from the above described control voltage source 133 is an alternating current signal of say 60 Hz and is shaped into a pulse signal of say 60 Hz by means of a wave shaping circuit 219 comprising a transistor, a diode and a capacitor, whereupon the pulse signal is applied to the input terminal INT. Each time the pulse signal obtained from the wave shaping circuit 219 is applied to the input terminal INT, the microprocessor 201 interrupts any other processing, whereupon timing processing is performed. More specifically, the microprocessor 201 functions to generate a signal representing "second", a signal representing "minute", and a signal representing "hour" in synchronism with the above described pulse signal of 60 Hz.

Finally, the output terminals OM and OP are a heat command terminal and an output level command terminal, respectively. In performing a heat processing operation, the microprocessor 201 just provides an output signal at the output terminal OM and then provides an output signal at the output terminal OP with a slight delay. Upon completion of execution of the heating operation, the output signals at the two terminals OM and OP are withdrawn. If and when the output signal is obtained at the output terminal OM, the first transistor 129 is rendered conductive and accordingly the relay 121 is energized. Accordingly, the normally closed contact 123 is turned off and the normally opened contact 125 is turned on. Accordingly, a short circuit state of the gate electrode 119 of the bidirectional thyristor 107 is released and the blower motor 121 is energized. When the output is obtained from the output terminal OP thereafter, the second transistor 131 is rendered conductive and the photocoupler 117 becomes operative. Then the output signal at the output terminal OP is obtained for a time period associated with an output level being set within each cycle which is determined as 10 seconds, for example. Assuming that a microwave output generated by the magnetron 105 is selected to be the maximum level, for example, the output signal is obtained for a full period of time in each cycle, and assuming that the microwave output is selected to be a 50% level, the output signal is obtained for five seconds, for example, within each cycle.

FIG. 5 is a block diagram of the microprocessor 201. The microprocessor 201 comprises an arithmetic logic unit 201*a*, an accumulator 201*b*, a random-access memory 201*c*, a random-access memory buffer 201*d*, an input/output interface 201*e* and a control unit 201*j*. A data bus 201*f* is provided for communication of information between these blocks. The control unit 201*j* performs functions of controlling communication of information among these blocks. External input signals IC1, IC2, IT, IK1 to IK4 and external output signals DS1 to DS9, DG1 to DG6, OB, OP, OM and OT1 to OT4 are inputted and outputted through the input/output interface 201*e*.

The microprocessor 201 further comprises a reference clock signal generator 201*g*, an interrupt control unit 201*h* and a reset unit 201*i*. The reference signal generator 201*g* cooperates with an external component 203 shown in FIG. 2 to generate a reference clock signal of 400 kHz, for example. The interrupt control unit 201*h* is responsive to the interrupt signal INT obtained from a wave shaping circuit 219 to command an interrupt operation for the purpose of a required timing operation. The reset unit 201*i* is responsive to the reset signal RES to command a required reset operation.

The control unit 201*j* comprises a read only memory 201*k*. The read only memory 201*k* contains a system program as shown in FIG. 10 and a programmable counter, not shown, to be described subsequently.

The random-access memory buffer 201*d* comprises storing regions "TIME B", "COOK B", "TEMP B", "TMB", "TPB", "COB", "STG1B", "STG2B", "STG3B", "TMF", "TPF" and "COF", as shown in FIG. 6A. Those regions other than the regions "TIME B", "COOK B" and "TEMP B" are each of a one bit length.

The random-access memory 201*c* is formed, at each of the stages 1, 2 and 3, or regions "TIME", "COOK", "TEMP", "TM", "TP", "CO" and "STG". The length or capacity of the respective regions of the random-access memory 201*c* are the same as that of the corresponding regions of the buffer 201*d*.

The regions "TIME" of the buffer 201*d* and the random-access memory 201*c* are allotted for storing a timer time period in a timer operation mode. The regions "COOK" are allotted for storing a numerical value associated with the output of a microwave generated by a magnetron shown in FIG. 2. The regions "TEMP" are allotted for storing data of a temperature to which a material being cooked is to be heated in a temperature operation mode. The regions "TM", "TP", "CO" and "STG" are allotted for storing flags, respectively.

Now that a structure of a preferred embodiment of the present invention was described in the foregoing, a control operation by the microprocessor 201 will be described in detail in the following in conjunction with an example of a key operation by the operation portion 14 and an example of display manners by the display portion 15.

STANDBY STATE

As far as the microwave oven is in an enabled state, the microprocessor 201 is responsive to the input signal at the input terminal INT to perform a timing operation as described previously irrespective of a key operation by the operation portion 14 and the current time is renewed by a current time storing region which is an accessible region included in the random access memory of the microprocessor 201. Now assuming that no key operation is made by the operation portion 14 and therefore the microwave oven is in a standby state, then the current time is normally displayed by the display 15. FIG. 7 shows such a display manner and in the case of the display manner shown twenty-eight minutes past three o'clock is displayed.

TIME ADJUSTMENT

In order to adjust the current time displayed by the display 15 to say just 4 o'clock, the following key operation is made by the operation portion 14:

[TOD] [4] [0] [0] [TOD]

Upon entering "400" following depression of the TOD key, the data representing the time of just 4 o'clock is written in the current time storing region of the microprocessor 201 and the second depression of the TOD key just at 4 o'clock completes time adjustment.

RUNNING OPERATION

Consider, for example, a case where, as a first stage, a timer operation is first executed with the 80% output value of the maximum microwave output for a time period of five minutes thirty seconds, whereupon, as a second stage, a temperature operation is executed with the 50% output value of the maximum microwave output for raising the temperature of a material being cooked to 165° F., whereupon, finally as a third stage, a timer operation is executed with the 80% output value of the maximum microwave output for a time period of ten minutes. In such a case, the following manual key operations are made by means of the operation portion 14:

| | | | | | | | | |
|---|---|---|---|---|---|---|---|---|
| TIME | 5 | 3 | 0 | | COOK | 8 | 0 | MEMORY |
| TEMP | 1 | 6 | 5 | | COOK | 5 | 0 | MEMORY |
| TIME | 1 | 0 | 0 | 0 | COOK | 8 | 0 | START |

In the above described data setting, the input data is once entered in the respective regions of the above described buffer **201*d* and then the same is divided into the corresponding regions of the respective stages of the random-access memory 201*c*. The contents in the respective regions of the buffer 201*d* are displayed in the display portion 15**.

FIG. 8 shows transition of the data being written in the respective storing regions of the buffer **201*d*** in the above described data setting. It would be appreciated that if and when a certain functional key is manually operated in a standby state the logic one is unconditionally written in the region "STG1B". Meanwhile, in the figure, blank portions each indicate a cleared state.

FIGS. 9A to 9J are display manners by the display portion 15 in each of the key manual operation steps as shown as the steps A to J in FIG. 8. Meanwhile, the indications "TIME", "TEMP", "COOK", "STAGE1", "STAGE2" and "STAGE3" by the bar segments are made by referring to the regions TMF, TPF, COF, STG1B, STG2B and STG3B of the buffer **201*d***.

If and when the MEMORY key or the START key are manually operated in the above described key manual operation, the microprocessor 201 refers to the regions STG1B, STG2B and STG3B of the buffer **201*d*. The microprocessor 201 operates such that the contents in the respective regions of the buffer 201*d* are transferred to the respective corresponding regions in the first stage of the random-access memory 201*c* if and when the region STG1B is the logic one, to the respective corresponding regions in the second stage if and when the region STG2B is the logic one, and to the respective corresponding regions of the third stage if and when the region STG3B is the logic one. Accordingly, in the key manual operation shown in the step E shown in FIG. 8, for example, "530" and "80" are written in the respective regions TIME1 and COOK1 of the first stage of the random-access memory 201*c* and the logic one is written in the respective regions TM1, CO1, and STG1. The other operation by the MEMORY key manual operation will be described subsequently with reference to the FIG. 5** program.

If and when the above described START key is manually operated, the microprocessor refers to the region STG1, thereby to determine that the operation is in the first stage operation and then determines that the operation is in the timer operation because the region TM1 is the logic one. Accordingly, the microwave oven executes a timer operation in accordance with the contents in the regions TIME1 and COOK1. In the above described case, the operation is a timer operation with the 80% output value for a time period of five minutes thirty seconds. After the operation the region STG1 representing the above described stage is cleared or reset.

The microprocessor then refers to the region STG2 to determine that the operation is the second stage operation and then determines that the operation is a temperature operation because the region TP2 is the logic one. Accordingly, the microwave oven executes the temperature operation in accordance with the content in the regions TEMP2 and COOK2. After the operation is ended, the region STG2 representing the above described stage is cleared or reset.

Finally, the microprocessor refers to the region STG3, thereby to determine that the operation is the third stage operation and to determine that the operation is a timer operation because the storing region TM3 is the logic one. Accordingly, the microwave oven executes the timer operation in accordance with the contents in the regions TIME3 and COOK3. After the operation is ended, the region STG3 representing the above described stage is cleared or reset.

The microprocessor then determines completion of the operation by the fact that the regions STG1 to STG3 are all in a cleared state and enters into the above described standby state after clearing all the storing regions other than those storing regions, not shown, for the current time.

The above described respective stages may be either of a timer operation and a temperature operation and the operation of only the first stage or of only the first and second stages is executed in the same manner. In initiation of the operation of the respective stages, the respective regions of the relevant stages are transferred to the respective corresponding regions of the buffer **201*d* and in case of a timer operation the logic one is written into the region TMF, while in case of a temperature operation the logic one is written into the region TPF. After initiation of the operation, a timing operation is executed in the region TIMEB and the content in the region TIMEB is indicated as a time left in the timer by the display portion 15. In case of a temperature operation, the measured temperature of a material being cooked as measured by means of the probe 20 is entered into the region TEMPB and is displayed by the display portion 15**. Furthermore, the microprocessor refers to the regions STG1B, STG2B, STG3B, TMF, TPF and COF, whereby the corresponding bar segments are enabled to make display.

At each completion of the respective stage of operation, a signal is obtained at the terminal OB of the microprocessor for a predetermined time period, so that the buzzer is energized to raise an alarm. If and when the door 13 is opened during the execution of the operation of the respective stages, the same is detected responsive to the input signal at the terminal IC1, whereupon the operation is interrupted. Furthermore, if and when the probe 20 is not connected on the occasion of the temperature operation, the same is detected responsive to the input signal at the terminal IC2, whereupon the operation is inhibited. Furthermore, if and when the STOP key is manually operated at the operation portion 14 during the execution of the operation of the respective stages, the operation is interrupted. The interrupted state due to the above described door opening or the STOP key operation is released by manual operation of the START key, subject to the door being closed at that time.

If and when the CLEAR key is manually operated during the above described data setting or the interruption due to the above described door opening or the STOP key operation, all the storing regions other than those storing regions for the current time are all cleared, whereupon the microwave oven enters into the above described standby state. Since the control of the above described operation states is well known, a detailed description thereof will be omitted.

The contents of the operation in the above described respective stages can be suitably changed by the use of the MEMORY key on the occasion of data setting or during the execution of the operation. For the purpose of executing such changing operation, the microprocessor contains a program as shown in FIG. 10 in conjunction with the MEMORY key and the FIG. 10 program will be described in the following.

At the step M1 which is the first step of the program, the region TMB is referred to and, if and when the region is the logic one the program shifts to the step M3, whereas the region TMB is the logic zero the program shifts to the step M2. At the step M2 the region TMP is referred to and, if the region TPB is the logic one the program shifts to the step M3, whereas if the region TPB is the logic zero the program shifts to the step M23. At the step M3, the region STG1B is referred to and, if the region STG1B is the logic one the program shifts to the step M4, whereas if the region STG1B is the logic zero the program shifts to the step M13.

At the step M4 the content in the respective regions of the buffer are transferred to the corresponding regions of the first stage. At the following step M5 the respective regions of the second stage are transferred to the corresponding regions of the buffer. At the following step M6, the logic zero, one and zero are written in the regions STG1B, STG2B and STG3B, respectively. The program then shifts to the step M7.

At the step M13, the region STG2B is referred to and, if the region STG2B is the logic one the program shifts to the step M14, whereas if the region STG2B is the logic zero the program shifts to the step M17. At the step M14, the contents in the respective regions of the buffer are transferred to the corresponding regions of the second stage. At the following step M15, the contents in the respective regions of the third stage are transferred to the corresponding regions of the buffer and at the following step M16 the logics zero, zero and one are written into the regions STG1B, STG2B and STG3B, respectively. The program then shifts to the step M7.

At the step M17, the region STG1 is referred to and, if the region STG1 is the logic one the program shifts to the step M18, whereas if the region STG1 is the logic zero the program shifts to the step M21. At the step M18, the contents in the respective regions of the buffer are transferred to the corresponding regions of the third stage. At the following step M19, the contents in the respective regions of the first stage are transferred to the corresponding regions of the buffer and at the following step M20, the logics one, zero and zero are written into the regions STG1B, STG2B and STG3B, respectively. The program then shifts to the step M7.

At the step M7, the logic zero is written into the regions TMF, TPF and COF. At the following step M8, the region TPB is referred to and, if the region TPB is the logic one the program shifts to the step M9, whereas if the region TPB is the logic zero the program shifts to the step M10. At the step M9, the logic one is written into the region TPF and the program shifts to the step M12. At the step M10, the region TMB is referred to and, if the region TMB is the logic one the program shifts to the step M11, whereas if the region TMB is the logic zero the program shifts to the step M12. At the step M11, the logic one is written into the region TMF.

At the step M12, display processing and key detection processing are performed. More specifically, in the display processing, if the region TMB is determined as the logic one the content in the region TIMEB is displayed and if the region TPB is determined as the logic one the content in the region TEMPB is displayed. Furthermore, the regions STG1B to STG3B, TMF and TPF are referred to and the corresponding bar segments are enabled to make display. In the key detection processing, if and when any of the TIME key, the COOK key, the TEMP key and the numeral keys is manually operated, the above described data setting is performed responsive to such key operation and if the MEMORY key is manually operated, then the program returns to the above described step M1, and if the CLEAR key is manually operated, all the storing regions other than those regions for the current time are cleared, whereupon the processor enters into the above described standby state. Unless the above described key manual operations are made, the program remains in the step M12.

At the step M21, the region STG2 is referred to and, if the region STG2 is the logic one the program shifts to the step M22, whereas if the region STG2 is the logic zero the program shifts to the step M12. At the step M22, the contents in the respective regions of the buffer are transferred to the corresponding regions of the third stage. The program then shifts to the step M5.

At the step M23, the region STG1B is referred to and, if the region STG1B is the logic one the program shifts to the step M12, whereas if the region STG1B is the logic zero the program shifts to the step M24. At the step M24, the region STG2B is referred to and, if the region STG2B is the logic one the program shifts to the step M25, whereas if the region STG2B is the logic zero the program shifts to the step M28. At the step M25, the logic zero is written into the region STG2. At the following step M26, the contents in the respective regions of the first stage are written into the corresponding regions of the buffer and at the step M27 the logics one, zero and zero are written into the regions STG1B, STG2B and STG3B, respectively. The program then shifts to the step M7.

At the step M28, the region STG1 is referred to and, if the region STG1 is the logic one the program shifts to the step M29, whereas if the region STG1 is the logic zero the program shifts to the step M30. At the step M29, the logic zero is written into the region STG3, whereupon the program shifts to the step M26.

At the step M30 the logic zero is written into the region STG3 and at the following step M31 the contents in the respective regions in the second stage are transferred to the corresponding regions in the buffer.

At the following step M32 the logics zero, one and zero are written into the regions STG1B, STG2B and STG3B, respectively, whereupon the program shifts to the step M7.

Figure 9:
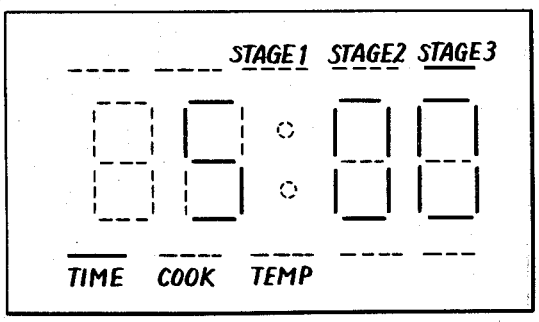
FIGS. 9A to 9J are views showing display manners by the display portion corresponding to the steps A to J in FIG. 8, respectively.

Now the progress of the above described program by the use of the MEMORY key in the data setting will be described in the following. Considering the first manual operation of the MEMORY key in the above described key operation, i.e. the step E shown in FIG. 8, the program proceeds through the steps M1, M3 to M8 and M10 to the step M12. It should be noted that at the above described step M5 the respective regions in the second stage are in a cleared state. Then at the step M12 the same become a display state as shown in FIG. 9E.

Now considering the second manual operation of the MEMORY key, i.e. the step H in FIG. 8, the program proceeds through the steps M1, M2, M3, M13 to M16, M7, M8 and M10 to the step M12. It should be noted that at the above described step M15 the respective regions in the third stage are in a cleared state. At the step M12 the same become a display state shown in FIG. 9H.

Now consider a case where the MEMORY key is manually operated in place of the START key at the stage of the above described manual operation of the START key, i.e. at the stage immediately after the step J in FIG. 8. At that time the program proceeds through the steps M1, M3, M13, M17, M18 to M20, M7, M8, M10 and M11 to the step M12. The display state in that case is the same as shown in FIG. 9B. In order to change a timer period, it is sufficient to manually operate the numeral keys. In order to change to six minutes, for example, key manual operation may be made in the order of [0] [0] [6] [0] [0], whereby a time period of six minutes may be set. More specifically, since the region TIMEB for a timer period is of four digits and the numerals are registered from the least significant digit while the same are leftward shifted in the region TIMEB, unnecessary numerals previously set are overflowed in succession from the most significant digit to disappear, whereby a time period of six minutes may be set.

In order to change the output value, first the COOK key is manually operated. A display state in such a case is the same as shown in FIG. 9D. Accordingly, in order to change to a 50% output value, it is sufficient to manually operate the numeral keys in the order of [5] [0] More specifically, since the region COOKB for the output value is of two digits, likewise unnecessary numerals disappear through overflowing, whereby the newly intended 50% may be set.

Since the region STG1B is the logic one at that time, now the first stage setting is in progress and therefore the operation content in the first stage is changed in the course of setting.

When the MEMORY key is manually operated following the manual operation of the MEMORY key for changing the operation content in the above described first stage, the program proceeds through the steps M1, M3, M4 to M9 to the step M12. A display state in such a case is the same as shown in FIG. 9F.

In order to change the set temperature, it is sufficient to manually operate the numeral keys. For example, in order to change to 150° F., for example, it is sufficient to manually operate the keys in the order of [1] [5] [0]. Since the region TEMPB for the temperature is of three digits, likewise unnecessary numerals disappear through overflowing, whereby the newly intended 150° F. may be set.

In order to make change of the output value, first the COOK key is manually operated, a display state in such a case is the same as shown in FIG. 9G and a manual operation for changing the output value is the same as in case of the above described first stage.

Since the region STG2B is the logic one, the second stage setting is in progress and it follows that the operation content in the above described second stage is changed in the setting stage.

Now if the MEMORY key is manually operated following a manual operation of the MEMORY key for changing the above described second stage, the program proceeds through the steps M1, M2, M3, M13 to M16, M7, M8, M10 and M11 to the step M12. A display state in such a case is the same as shown in FIG. 9I.

Just as in case of the above described first stage, therefore, changes can be made of a timer period and an output value.

Although in the above described examples the second stage and the third stage are directly read out through a consecutive manual operation of the MEMORY key, it would be apparent that by manually operating the MEMORY key following a manual operation for a change at the respective stages the following stage can be read out.

Thus the first to third stages can be cyclically read out by the use of the MEMORY key; however, now consider a case in which it is desired that the content of the first stage, already set in the setting stage of the second stage (the step G in FIG. 8), be changed. In such a case the MEMORY key is manually operated. When the MEMORY key is manually operated, the program proceeds through the steps M1, M2, M3, M13 to M16, M7, M8 and M10 to the step M12. More specifically, a setting state of the third stage is attained. If and when the MEMORY key is manually operated again, then the program proceeds through the steps M1, M2, M23, M24, M28, M29, M26, M27, M7, M8, M10 and M11 to the step M12. Thus a setting state in the first stage is attained.

Now consider a case where erroneously the MEMORY key is manually operated without entering a timer period immediately after manual operation of the TIME in the setting state of the first stage. In such a case the program proceeds through the steps M1, M2 and M23 to the step M12, whereupon the first stage setting state still continues. This also applies to manual operation of the TEMP key.

If a similar erroneous manual operation is made in the second stage, the program proceeds through the steps M1, M2, M23, M24 to M27, M7, M8, M9 (or M10 and M11) to the step M12, whereby the first stage setting state is regained.

Now in changing the operation content in the course of execution of the operation of any stages, the STOP key is manually operated. By manually operating the MEMORY key following the operation of the STOP key, likewise a desired stage can be read out. More specifically, assuming that the first, second and third stages are set as shown in FIG. 8, for example, and the operation is executed based on the thus set cooking conditions and then the operation is in an interruption state in the course of execution of the operation of the second stage, then by manually operating the MEMORY key in such a situation the program proceeds through the steps M1, M2, M3, M13 to M16, M7, M8, M10 and M11 to the step M12 and accordingly the operation is in the third stage setting state, so that likewise the content in the said stage can be changed.

By further manually operating the MEMORY key, the program proceeds through the steps M1, M3, M13, M17, M21, M22, M5, M6 to M9 to the step M12, so that the second stage setting stage is attained and likewise the content in the said stage can be changed. Meanwhile, it should be noted that since the first stage has already been executed the setting stage in the first stage is thus omitted.

Now let it be assumed that in a situation where the operation content has been set in the first and second stages and no operation content has been set at all in the third stage (at the step G in FIG. 8) the operation is executed and now the operation is in an interruption state in the execution of the operation of the second stage. By manually operating the MEMORY key in such a situation, the program proceeds through the steps M1, M2, M3, M13 to M16, M7, M8, M10 and M11 to the step M12. In other words, the setting state in the third stage is attained. Therefore, by manually operating the MEMORY key again, the program proceeds through the steps M1, M2, M23, M24, M28, M30 to M32 and M7 to M9 to the step M12, whereby a setting state of the second stage is regained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for controlling an electronic controlled cooking apparatus, comprising;

entry means for entering data concerning a cooking condition with respect to a material being cooked, storage means having a plurality of memory stages each for storing a respective group of cooking mode data concerning at least one cooking condition as entered by said entry means, each of said groups corresponding to a stage in a multi-stage cooking operation;

stage designating means for designating a particular group of cooking mode data for storage in any desired stage of said storage means when said particular cooking mode data is entered by the use of said entry means said stage designating means comprising:

a specified function key for setting said respective groups of cooking mode data to be performed in a desired order; and cyclic stage accessing means responsive to manual operation of said specified key for identifying and accessing a corresponding stage of said storage means as a function of the number of times of manual operation of said specified function key, said stage accessing means comprising;

means responsive to each manual operation of said specified function key for successively accessing each of said predetermined number of stages from an initial stage to a final stage, and means responsive to manual operation of said specified function key after accessing of said final memory stage for further accessing said initial memory stage;

said apparatus further comprising cooking means responsive to said cooking mode data stored in each of said stages of said storage means for cooking said material being cooked by applying said entered cooking conditions in a stage by stage succession, from said initial stage to said final stage.

2. An apparatus for controlling an electronic controlled cooking apparatus in accordance with claim 1, wherein said entry means comprises a plurality of other function keys, and said stage accessing means comprises means responsive to manual operation of any of said other function keys before manual operation of said specified function key for accessing said initial stage out of the stages of said storage means.

3. An apparatus for controlling an electronic controlled cooking apparatus in accordance with claim 2, wherein each said stage of said storage means is identified by a predetermined number in advance, and which further comprises stage number display means for displaying the number of the stage presently accessed by said stage accessing means.

4. An apparatus for controlling an electronic controlled cooking apparatus in accordance with claim 3, which further comprises cooking condition data display means for displaying at least a portion of said cooking mode data concerning a cooking condition set in said stage accessed by said stage accessing means.

5. An apparatus for controlling an electronic controlled cooking apparatus in accordance with claim 4, wherein said cooking condition data display means and said stage number display means are structured such that each comprises a portion of a common display.

6. An apparatus for controlling an electronic controlled cooking apparatus in accordance with claim 4, wherein said entry means comprises means for setting at least a timer operation mode and a temperature operation mode, and said cooking condition data display means operates to display a timer period when said timer operation mode is set and to display temperature data when said temperature operation mode is set.

7. An apparatus for controlling an electronic controlled cooking apparatus in accordance with claim 4, wherein said cooking means comprises means for generating cooking energy, and said cooking condition data display means comprises means for displaying numerical values associated with said cooking energy.

8. An apparatus for controlling an electronic controlled cooking apparatus in accordance with claim 1, which further comprises:

a stop key included in said entry means, and means responsive to an operation of said stop key during a cooking operation for rendering effective an operation of said specified key.

9. An apparatus for controlling an electronic controlled cooking apparatus in accordance with claim 1, wherein each said stage of said storage means is capable of storing cooking mode data comprising a plurality of different cooking conditions for each stage.

10. An apparatus for controlling an electronic controlled cooking apparatus as in claim 1, wherein each of said memory stages is adapted to be capable of storing cooking mode data comprising a plurality of cooking conditions, said plurality of cooking conditions stored at each stage having a preferential order determined for display, and said apparatus further comprising display means for displaying at least one of the cooking conditions in a selected stage of said storage means in accordance with said preferential order when said specified key is operated.

11. An apparatus for controlling an electronic controlled cooking apparatus in accordance with claim 10, wherein said plurality of cooking conditions comprise at least a timer time period and a power level, and said display means preferentially displays said timer time period in response to operation of said specified key.

12. An apparatus for controlling an electronic controlled cooking apparatus in accordance with claim 10, wherein said plurality of cooking conditions comprise at least a temperature of a material being cooked and a power level, and said display means preferentially displays said temperature in response to operation of said specified key.

13. An apparatus for controlling an electronic controlled cooking apparatus in accordance with claim 10, wherein said plurality of cooking conditions comprise at least a power level, and which further comprises a power key for commanding a display of said power level by means of said display means, and wherein said display means displays the data concerning said power level in response to operation of said power key.

14. An apparatus as in claim 1, further comprising:

a specified function key, and means responsive to operation of said specified function key for enabling cooking mode data presently stored in the stage designated by said designating means to be replaced by new cooking mode data being entered by said entry means, independent of the data stored in the other stages of said storage means.

15. A microwave oven, comprising:

microwave generating means for providing heating energy to a material being cooked, key entry means comprising a plurality of cooking mode keys for entering data concerning a cooking condition, numerical value keys, and a specified function key, microprocessor means responsive to said cooking condition data entered by said key entry means for controlling said microwave generating means, said microprocessor means including storage means having a predetermined number of stages for storing in each of the stages cooking mode data comprising at least one cooking condition entered by said entry means, said microprocessor means being responsive to manual operation of said specified function key for individually accessing each of said plurality of stages of said storage means according to the number of manual operations of said specified function key; and said microprocessor means comprising means responsive to manual operation of said specified function key for sequentially accessing said predetermined number of stages in a cyclic manner.

16. A method for controlling stages of storage means in an electronic controlled cooking apparatus, said cooking apparatus comprising entry means for entering data concerning a cooking condition with respect to a material being cooked, said entry means having at least one cooking condition key for selecting a plurality of cooking conditions, numeral keys, and a specified function key, storage means for storing said cooking condition data entered from said entry means, said storage means having a plurality of successively defined stages including an initial, final and at least one intermediate stage, said successive stages being cyclically defined so that said initial stage successively follows said final stage, each said stage having a plurality of regions for storing a group of cooking mode data concerning at least one cooking condition, buffer memory means for temporarily storing cooking mode data corresponding to one of said stages as it is being entered from said entry means, and having buffer storage regions of the number corresponding to at least the number of said plurality of regions in said one of said stages of said storage means, at least one of said buffer storage regions being used as a flag region identifying which one of said plurality of stages of said storage means will be used to store the data which is presently being stored in said buffer memory means, said method comprising the steps of:

detecting said flag regions of said buffer memory means, corresponding to said plurality of stages of said storage means, responsive to manual operation of said specified function key, transferring said cooking mode data temporarily stored in said buffer memory means into the corresponding one of said stages of said storage means responsive to said detection of said flag regions, transferring the cooking mode data in the stage which successively follows said stage corresponding to said set flag to said buffer memory means, and changing the flag setting in said flag regions of said buffer memory means to the flag corresponding to said following stage.

17. A method in accordance with claim 16, wherein said step of transferring the cooking mode data in said buffer memory into the corresponding stage of said storage means comprises the step of transferring the cooking mode data in said buffer memory into the stage of said storage means corresponding to the flag set in said flag regions of said buffer memory means.

18. A method for controlling the stages in accordance with claim 12, which further comprises the step of displaying the cooking condition and stage identifying data in said buffer memory means.

19. An electronic controlled cooking apparatus, comprising:

entry means for entering data concerning a cooking condition with respect to a material being cooked, said entry means having at least one cooking condition key for selecting a plurality of cooking modes, numeral keys, and a specified function key, storage means for storing said cooking condition data entered from said entry means, said storage means having a plurality of successively defined stages, including an initial, final and at least one intermediate stage, said successive stages being cyclically defined so that said initial stage successively follows said final stage, each said stage having a plurality of regions for storing a group of cooking mode data comprising at least one cooking condition, buffer memory means for temporarily storing cooking mode data corresponding to one of said stages as it is being entered from said entry means, and having buffer storage regions of a number corresponding to at least the number of said plurality of regions in said one of said stages of said storage means, at least one of said buffer storage regions being used as a flag region identifying which one of said plurality of stages of said storage means will be used to store the data which is presently being stored in said buffer memory means, means for detecting said flag regions of said buffer memory means corresponding to said plurality of stages of said storage means, responsive to manual operation of said specified function key, means for transferring said cooking mode data temporarily stored in said buffer memory means into the corresponding one of said stages of said stroage means responsive to said detection of said flag regions, means for transferring the cooking mode data in the stage which successively follows said stage corresponding to said set flag to said buffer memory means, and means for changing the flag setting in said flag regions of said buffer memory means to the flag corresponding to said following stage.

20. Apparatus in accordance with claim 19, which further comprises means for displaying the cooking condition and stage identifying data in said buffer memory means.

* * * * *